US005451038A

United States Patent [19]

Hosking et al.

[11] Patent Number: 5,451,038

[45] Date of Patent: Sep. 19, 1995

[54] SHEET STACKING APPARATUS

[75] Inventors: Steven M. Hosking; Alexander C. H. James, both of Portsmouth, United Kingdom

[73] Assignee: De La Rue Inter-Innovation AB, Sweden

[21] Appl. No.: 195,326

[22] Filed: Feb. 9, 1994

[30] Foreign Application Priority Data

Feb. 16, 1993 [GB] United Kingdom ..... 9303093

[51] Int. Cl.[6] ..... B63H 5/22

[52] U.S. Cl. ..... 271/3.01; 271/6; 271/7; 271/35; 271/122; 271/125; 271/163; 271/178; 271/212; 271/902

[58] Field of Search ..... 271/3, 3.1, 6, 7, 34, 271/35, 121, 122, 124, 125, 163, 177–181, 198, 212, 902

[56] References Cited

U.S. PATENT DOCUMENTS

| | | | |
|---|---|---|---|
| 3,174,749 | 3/1965 | Childs | 271/212 X |
| 3,258,264 | 6/1966 | Stoothoff | 271/177 |
| 3,672,664 | 6/1972 | Santirocco et al. | 271/902 X |
| 3,753,559 | 8/1973 | Ries et al. | 271/3 X |
| 4,245,833 | 1/1981 | Akerstrom | 271/177 X |
| 4,285,511 | 8/1981 | Abe | 271/178 |
| 4,625,870 | 12/1986 | Nao et al. | 271/178 X |
| 4,682,768 | 7/1987 | Iida et al. | 271/3.1 |
| 5,280,896 | 1/1994 | Yamada | 271/212 X |

FOREIGN PATENT DOCUMENTS

| | | | |
|---|---|---|---|
| 626263 | 1/1936 | Germany . | |
| 37958 | 4/1981 | Japan | 271/212 |
| 295541 | 3/1954 | Switzerland . | |
| 1112545 | 5/1968 | United Kingdom | 271/177 |

*Primary Examiner*—H. Grant Skaggs
*Assistant Examiner*—Carol L. Druzbick
*Attorney, Agent, or Firm*—Ostrolenk, Faber, Gerb & Soffen;

[57] ABSTRACT

Sheet stacking apparatus comprises a sheet feed system formed by a belt (9) movable past a sheet stacking hopper (1) in a sheet accept direction to feed sheets to the hopper. At least one pusher member (23) is movable in the sheet accept direction through the hopper to push successive portions of a stack (24) in the hopper (1) out of the path of an incoming sheet so as to permit unrestricted entry of a sheet into the hopper.

14 Claims, 6 Drawing Sheets

SHEET STACKING APPARATUS

FIELD OF THE INVENTION

The invention relates to sheet stacking apparatus.

DESCRIPTION OF THE PRIOR ART

The invention is concerned with providing an improved means for stacking sheets, such as banknotes, where an existing stack of sheets is at the stacking position and a new sheet has to be inserted into the stack. For example, the stack may extend vertically and a new sheet has to be inserted at the bottom of the stack.

DE-C-626263 describes a bag stacking system. In this case, bags are fed between a pair of feed rollers to a stacking position. As a bag leaves the feed rollers it drops vertically onto a bracket carried on an endless chain which moves past a leading end of a stack of bags to push the stack away allowing the new bag to be stacked. This system may be suitable for bags which are relatively heavy and can take advantage of the effect of gravity. It is not suitable, however, for the handling of sheets such as banknotes.

SUMMARY OF THE INVENTION

In accordance with the present invention, sheet stacking apparatus comprises sheet feed means movable through a stacking position for feeding a sheet in a sheet accept direction to the stacking position; and at least one pusher member movable in the sheet accept direction through the stacking position to push successive portions of a stack at the stacking position out of the path of an incoming sheet so as to permit unrestricted entry of a sheet into the stack.

With this invention, successive portions of the sheet stack are pushed out of the way of the incoming sheet to permit the sheet to enter the stack while the sheet is positively fed into the stack.

The or each pusher member may take a variety of forms including for example a sliding protrusion but preferably the or each pusher member is positioned on part of an endless belt movable to cause the pusher member to pass through the stacking position. For example, the endless belt may have at least one profiled portion which defines the pusher member. The pusher member is preferably a low friction member and most preferably defines a V-shape with the open part of the V facing an incoming sheet.

Typically, there will be at least two pusher members, laterally spaced apart across the stacking position.

The sheet feed means may take any convenient form, for example feed rollers or suction belts but preferably comprise at least one relatively high friction, endless belt extending through the stacking position.

In some cases, the or each pusher member could be provided as part of the sheet feed means. For example, the sheet feed means could comprise an endless belt having a relatively high friction surface except where the or each pusher member is positioned.

Preferably, the or each pusher member is separate from the sheet feed means. This has the advantage that the pusher member(s) are there purely to provide a gap in front of sheets already at the stacking position and they do not influence the edge position of the sheet being fed.

Where the pusher member also forms part of an endless belt, the sheet feed means in the form of one or more endless belts and the pusher member belt or belts can be mounted to extend between rollers on a common axes although this is not essential. Preferably, however, both the sheet feed means and the pusher member are driven by a common motor.

In some cases, the sheet stacking apparatus can be used solely for the stacking of sheets into a cassette or the like. However, in some cases, the sheet feed means is reversible to enable sheets to be withdrawn from the stack, the or each pusher member being inoperative during the feeding of sheets from the stack. This leads to a particularly advantageous, compact apparatus which can both accept and dispense sheets. This will have particular application in banknote handling.

Where the or each pusher member and the sheet feed means are driven by a common motor, the motor is preferably coupled with the pusher member via a one way clutch such that during the feeding of sheets from the stack, no drive is communicated to the or each pusher member.

It is particularly important where sheets are to be dispensed from the stack that the risk of more than one sheet being dispensed during one operation is minimised. Preferably, therefore, the apparatus further comprises sheet separating means positioned upstream of the stacking position in the sheet accept direction, the sheet separating means defining a gap which is variable between first and second positions and through which sheets are fed by the sheet feed means, the first position being narrower than the second position. With this arrangement, a relatively narrow gap can be Set when sheets are to be dispensed while a relatively wider gap can be set when sheets are to be accepted thus minimising the risk of snagging, skewing and the like during the acceptance of sheets.

In some cases, the gap could be manually controlled with a suitable switching lever but conveniently the apparatus further comprises means for biasing the gap defined by the sheet separating means to the first position suitable for separating sheets fed out from the stacking position.

The sheet separating means can be provided by any conventional system, for example a pair of juxtaposed shoes, a cooperating shoe and roller, or, preferably, a pair of rollers. In the latter case, preferably one of the rollers forms part of the sheet feed means and, most preferably, the other roller rotates counter to the direction in which sheets are fed by the sheet feed means.

BRIEF DESCRIPTION OF THE DRAWINGS

Some examples of sheet stacking apparatus according to the invention will now be described with reference to the accompanying drawings, in which.

DETAILED DESCRIPTION OF THE EMBODIMENTS

Figure 1:
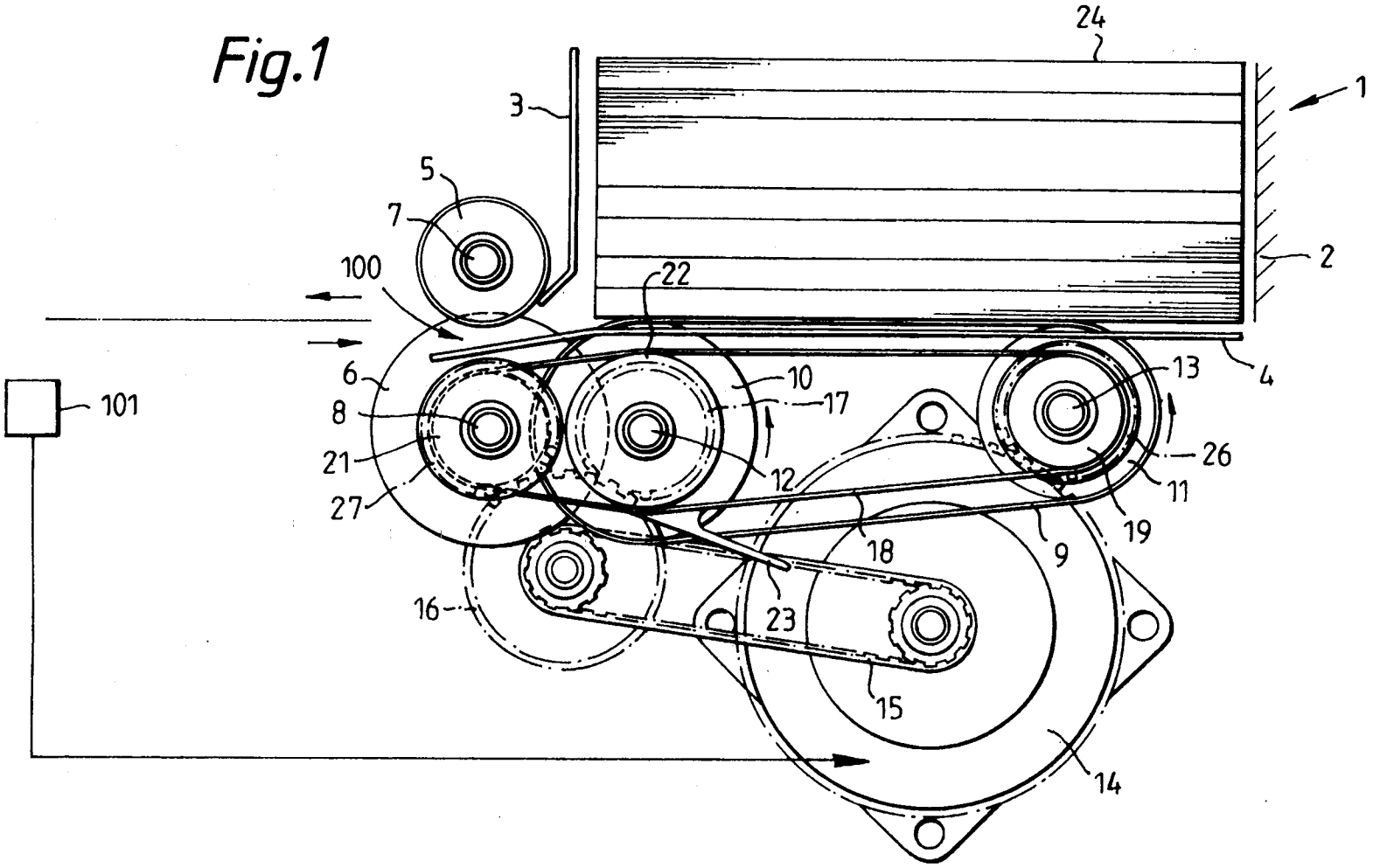
FIG. 1 is a schematic side elevation of one example of the apparatus.

The apparatus shown in FIG. 1 comprises a sheet stack hopper 1 defined by vertical front and back plates 2,3 and a horizontal base plate 4. Sheets from an input station (not shown) are fed by means (not shown), such as conveyor belts or the like, between a set of document separation rollers 5,6 mounted non-rotatably on respective shafts 7,8 and defining a gap 100 between them. Roller 5 is driven by the input station motor (not shown) and is always rotated as pictured in an anti-clockwise direction. The rollers 5,6 are both rotated in the incoming, accept direction of the sheets and impart a corrugation effect to the sheet being transported due to the overlap between the circumferences of the rollers. As the sheets pass through the gap 100 defined by the separation rollers 5,6 they are picked up by a pair of laterally spaced, relatively high friction feed belts 9 entrained around rollers 10,11 mounted on respective shafts 12,13.

The belts 9 are driven from a motor 14 (as pictured rotating anti-clockwise) via a drive belt 15 and a drive gear 16 which engages a drive gear 17 non-rotatably mounted to the shaft 12 and to which the rollers 10 are also non-rotatably mounted i.e. gear 17 rotates roller 10. The rollers 11 are rotatably mounted on shaft 13. Gear 16 also meshes with a gear 27 non-rotatably mounted to the shaft 8 and thus gear 27 is always rotated in the same direction as shaft 10 and rollers 17.

It will be appreciated that the rollers 10,11 protrude through the base plate 4 of the stack hopper 1 so that incoming sheets can be drawn into the hopper by the belts 9.

The apparatus also comprises a set of six laterally spaced, profiled belts 18 entrained about pulleys 19 non-rotatably mounted to the shaft 13, at one end, and about pulleys 21 rotatably mounted to the shaft 8. The belts 18 also pass around rollers 22 rotatably mounted to shaft 12.

The profiled nature of the belts 18 can be seen in FIG. 1 where a pusher member 23 is shown attached or forming part of the belt 18.

Figure 4:
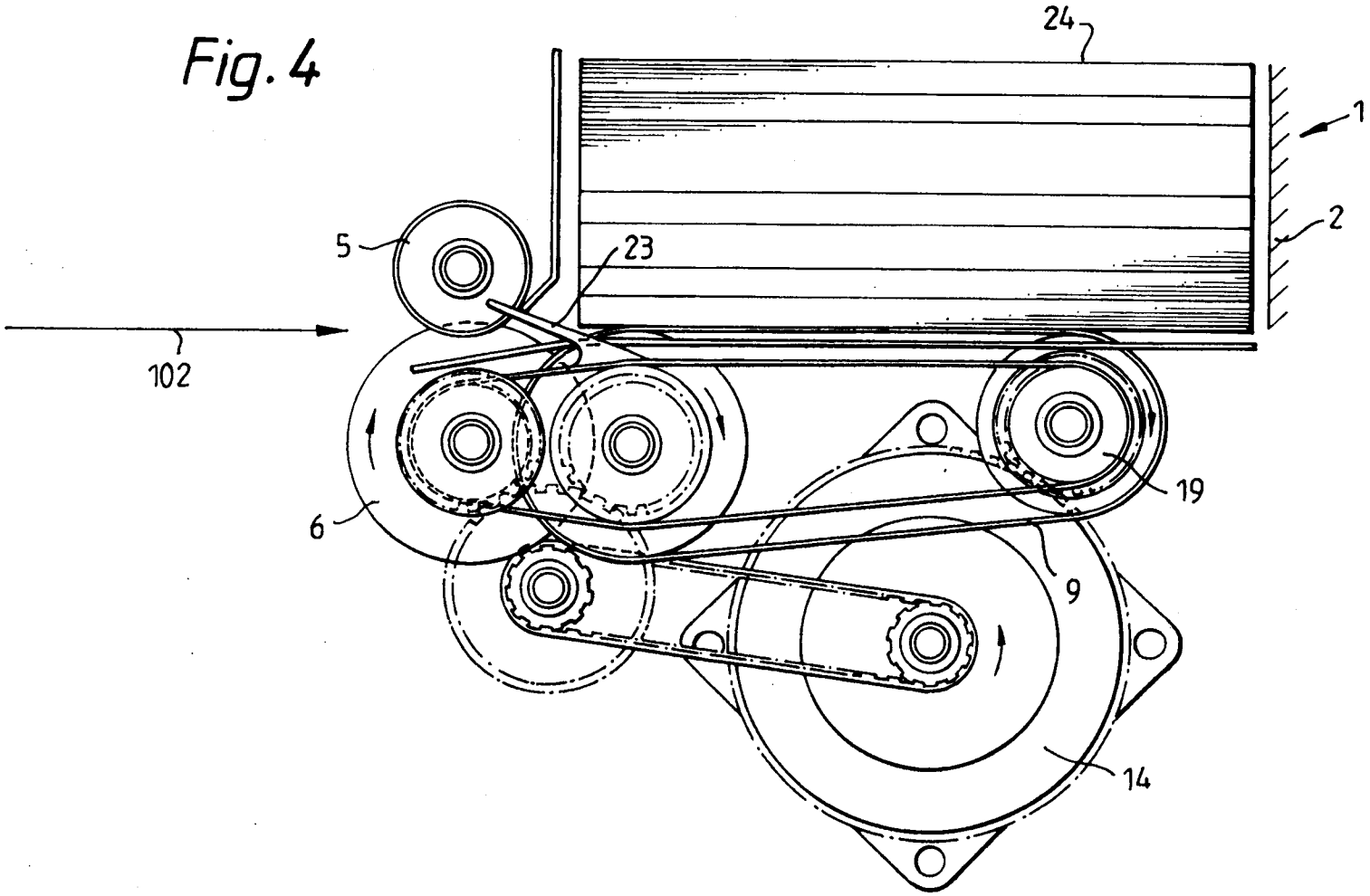
FIG. 4 is a view similar to FIG. 1 but showing the apparatus of FIG. 1 at the beginning of a sheet accepting operation.
Figure 5:
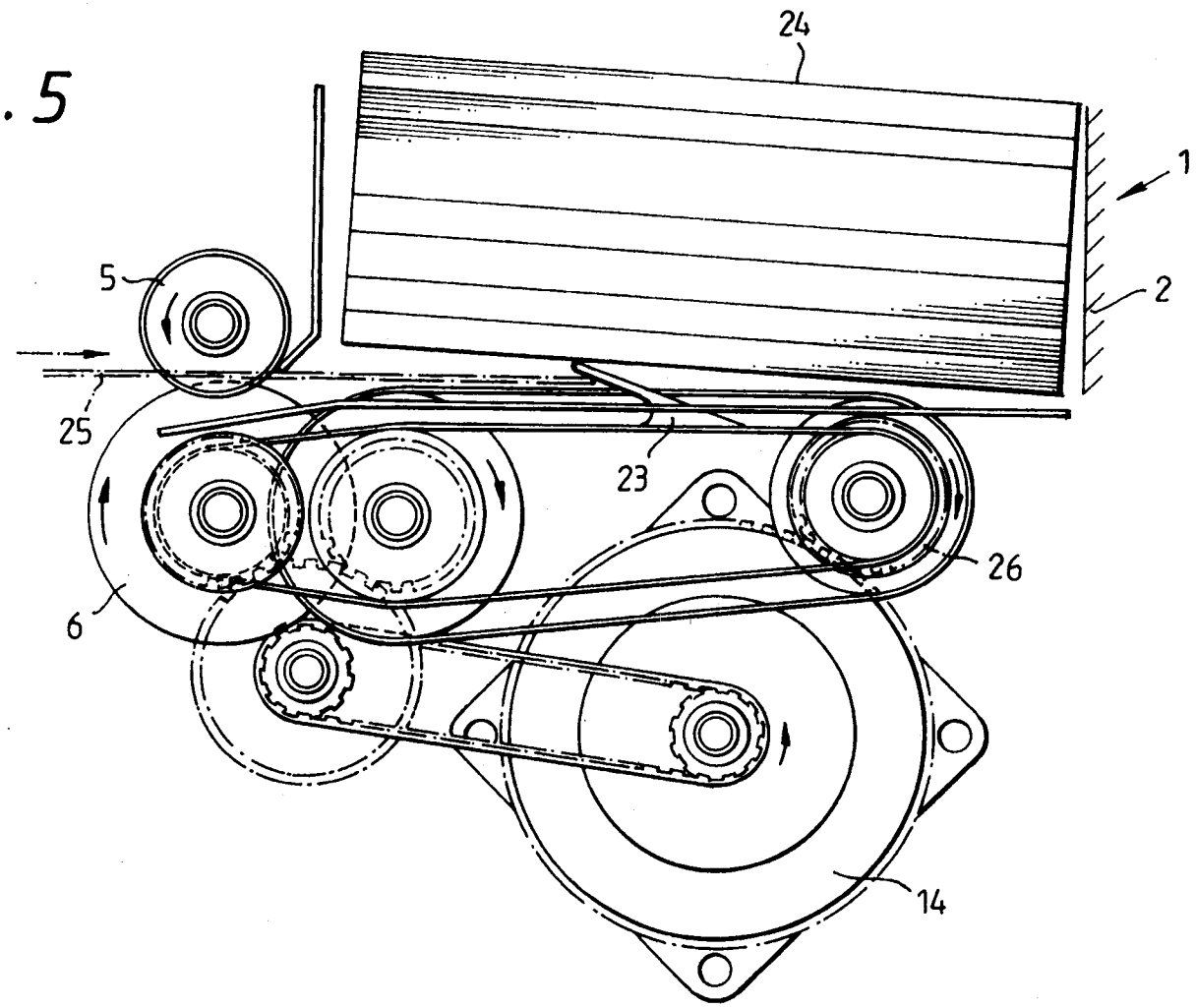
FIG. 5 is a view similar to FIG. 4 but showing the apparatus of FIG. 1 at a subsequent time during a sheet acceptance operation.

The operation of the apparatus will now be described in connection with a sheet accepting operation. It is assumed that there already exists a document stack 24 in the hopper 1 as shown in FIG. 1. As an incoming sheet approaches the separation system 5,6, this is detected by a sensor 101 and the motor 14 is initiated to rotate anti-clockwise. The operation is such that as a sheet 102 reaches the separation system 5,6 the motor 14 has caused the profiled belts 18 to rotate to the position shown in FIG. 4 where the profiled member 23 is positioned just upstream of the sheet stack 24. Operation of the motor 14 also causes movement of the high friction feed belts 9 which draw the incoming sheet 102 fed between the separation system 5,6 into the hopper 1 while at the same time the pusher member 23 is moved to the right by the motor 14 coupled to roller 19 and shaft 13 via a gear 26 which itself is coupled to shaft 13 via a one way clutch (not shown) which engages when the motor is rotated in an anti-clockwise direction, as seen in FIG. 1, to push the stack 24 upward as can be seen in FIG. 5. This allows an incoming sheet 25 to be fed underneath the stack 24. As the sheet 25 is fully fed into the hopper 1 and engages the front plate 2, the pusher member 23 will be moved back to the position shown in FIG. 1 and the stack 24 will return to its rest position (FIG. 1).

In a sheet dispense operation, the motor 14 is operated in the opposite sense (clockwise as seen in FIG. 1). In this mode, the pusher member 23 will remain in its parked position (FIG. 1) because the one way clutch will not engage when the motor is operated in this opposite sense and thus shaft 13 is not rotated. The belts 9 are driven however in the reverse direction and a sheet is dispensed. The separation system operates to prevent more than one sheet being dispensed by causing the rollers 5 to continue to rotate in an anti-clockwise direction (as they do during a sheet accepting operation).

Figure 2:
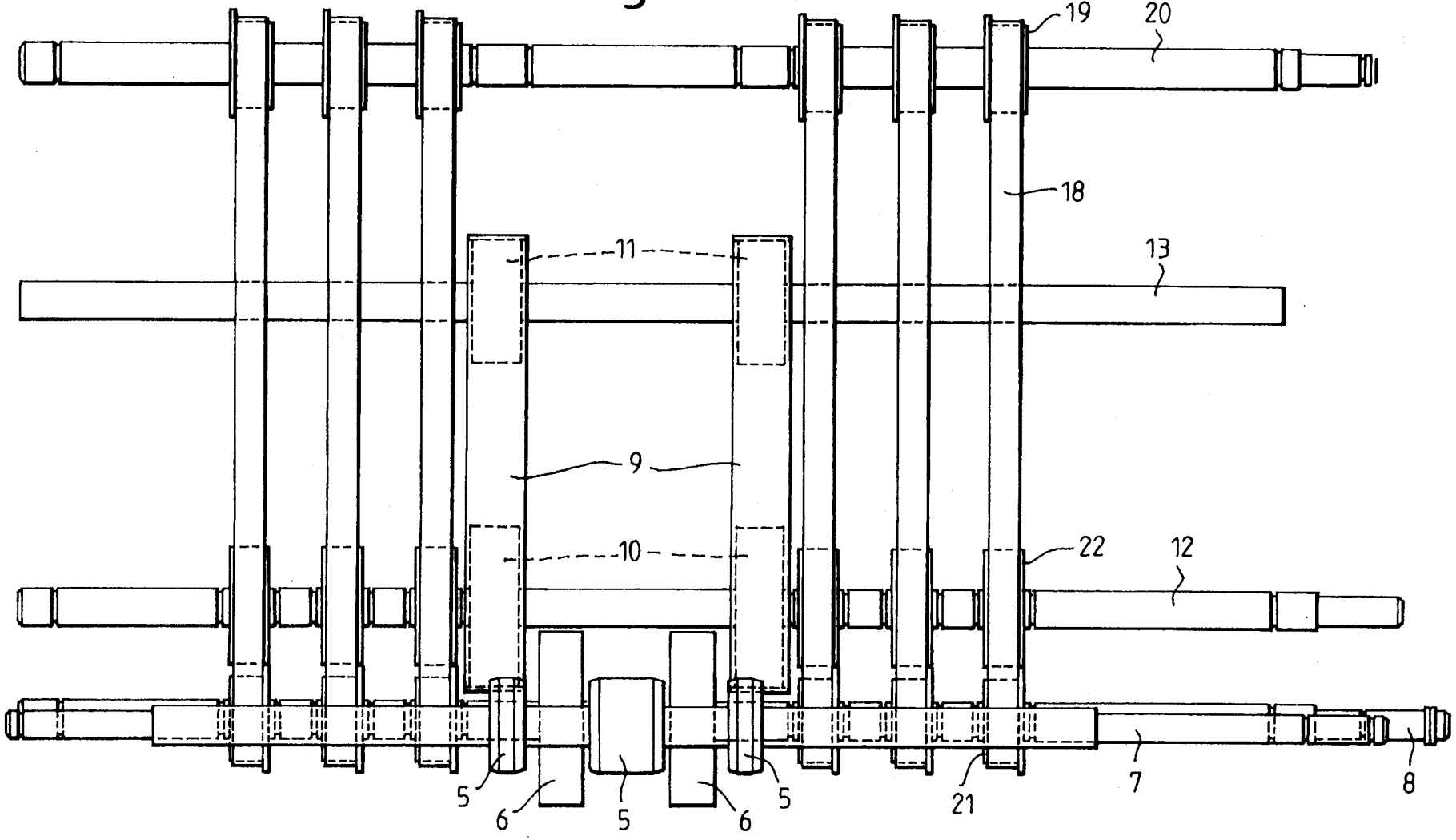
FIG. 2 is a schematic plan of a second example of the apparatus.

In the example described above (FIGS. 1, 4 and 5), the rollers 19 and 11 are mounted about a common shaft 13. This is not essential and in an alternative arrangement shown in FIGS. 2 and 3, the rollers 19 are mounted instead non-rotatably to a shaft 20. Motor 14 is coupled by a suitable gear train via a one way clutch to shaft 20 such that during a sheet accept operation the clutch engages and shaft 20 and rollers 19 rotate to move the pusher member 23. During the sheet dispense operation the clutch is dis-engaged and shaft 20 and rollers 19 remain stationary with the pusher member 23 position as in FIG. 1.

Figure 3:
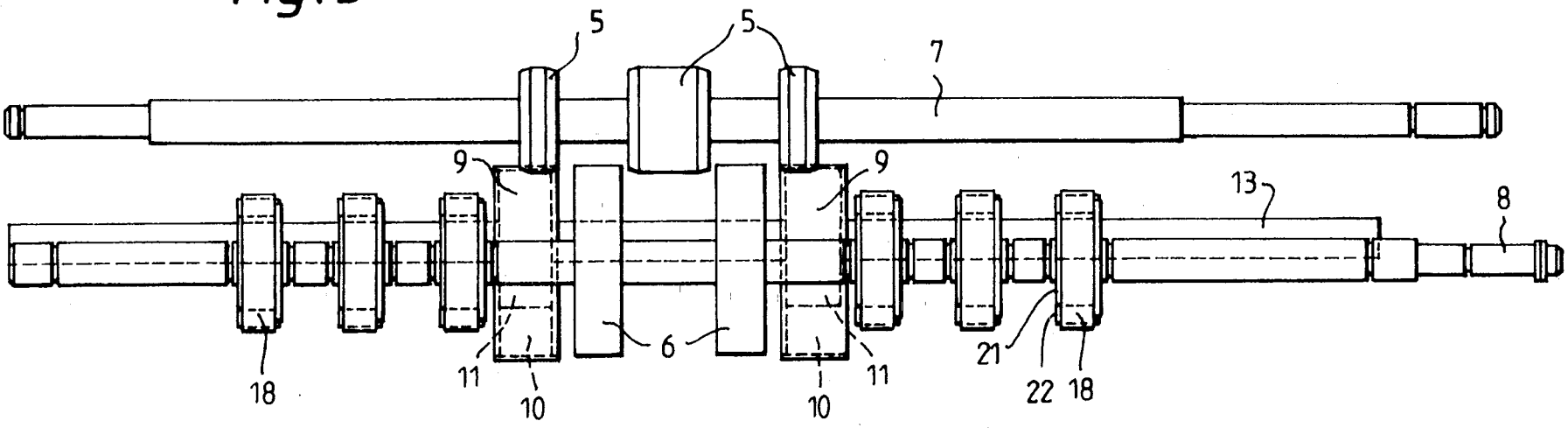
FIG. 3 is an end elevation of the apparatus shown in FIG. 2.

In this second example rollers 11 are rotatably mounted to shaft 14 which is a fixed shaft. FIG. 3 shows an end view of the FIG. 2 example although the end view of the FIG. 1 example (not shown) will appear similar.

Figure 6:
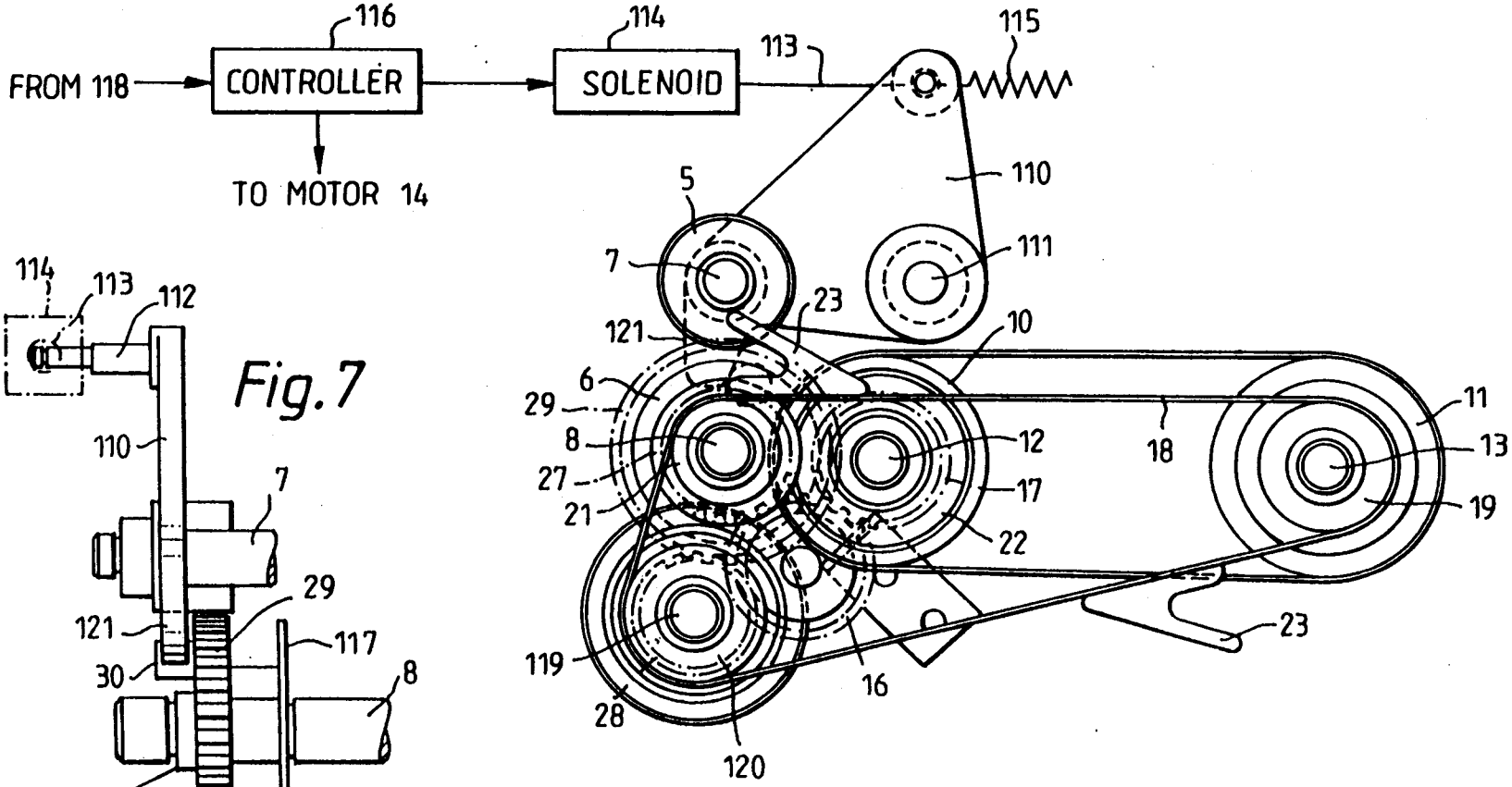
FIG. 6 is a view similar to FIG. 1 but of a third example with parts omitted for clarity.
Figure 7:
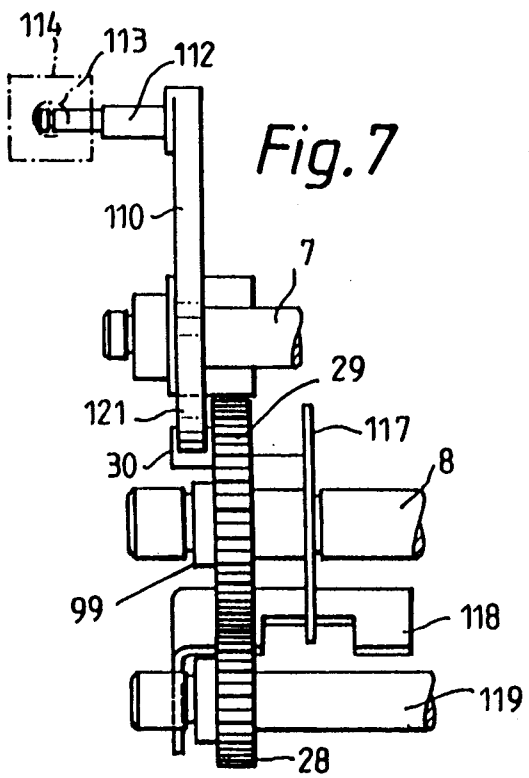
FIG. 7 is a partial end elevation of the apparatus shown in FIG. 6.

A further example is shown in FIGS. 6 and 7. In this example, an additional link plate 110 is mounted on each side plate (not shown) of the apparatus by a pivot 111. The shaft 7 on which the roller 5 is mounted is itself then mounted on the link plate 110. A drive pin 112 protrudes from each link plate 110 through a slot (not shown) in the side plates and is connected to a shaft 113 of an actuator, in this example a solenoid 114, and to the end of a return spring 115. The other end of the spring 115 is connected to a pin (not shown) mounted on the side plate. When the link plates 110 are in their rest position (held under spring force), the contra roller shaft 7 and roller 5 are held away from the separator roller 6 so that a relatively wide gap 100 exists between the rollers 5,6. The solenoid 114 is connected to a controller 116 of conventional form which responds to operator instructions to control operation of the solenoid and of the motor 14. Thus, when the operator wishes to dispense sheets a suitable signal is sent to the controller 116 which then actuates the motor 14 in a clock-wise direction, as explained above, and at the same time actuates the solenoid 114 to pivot the link plate 110 about the pivot 111 against the bias of the spring 115. This narrows the gap 100 between the rollers 5,6 as required during a dispense operation. The gap will then be similar to that shown in FIG. 3.

The advantage of being able to vary the separation gap 100 is that it allows a wide gap to be set during a sheet accepting mode so as to prevent the leading end of sheets stubbing on the separator/contra-roller system leading to the possibility of damage or skewing or jamming of sheets. However, during the sheet dispense operation the gap can be narrowed as required.

A single slot timing disk 117 is non-rotatably mounted to the separator roller shaft 8 and passes between components of a timing disk sensor 118 whose output is coupled to the controller 116. The function of the timing disk 117 is to provide a means of monitoring the rotation of the shaft 8 to provide signals to the controller 116 for switching and control purposes.

FIGS. 6 and 7 also illustrate a further modification. In this example, the motor 14 (not shown) directly drives only the gear 16 which engages gear 17 (fixed to shaft 12), gear 27 (fixed to shaft 8) and a further gear 28 which drives an additional profile belt drive shaft 119 via a one way clutch 99 that is fitted on gear 29. The profile belts extend around pulleys 120 non-rotatably mounted to the shaft 119.

The drive gear 28 also meshes with a gear 29 rotatably mounted on the shaft 8. Mounted from the side of the gear 29 is a stop pin 30 which, when the apparatus is operated in the sheet accept mode, will, on actuation of the link plates 110 be stopped by an arm 121 extending from one of the link plates 110. This engagement stops rotation of the profile belt shaft so that the members 23 are in the correct position for sheet acceptance.

In this modification, the shaft 13 is modified so that it is no longer driven and the profile belt pulleys 19 are rotatably mounted on the shaft. It will also be noted that each belt 18 carries two pusher members 23.

We claim:

1. Sheet stacking apparatus comprising sheet feed means movable through a stacking position for feeding a sheet in a sheet accept direction to said stacking position, at least one pusher member movable in said sheet accept direction through said stacking position independently of said sheet feed means to push successive portions of a stack at the stacking position out of the path of an incoming sheet so as to permit unrestricted entry of a sheet into the stack, and said at least one pusher member being positioned on part of an endless belt movable to cause said at least one pusher member to pass through the stacking position.

2. Apparatus according to claim 1, wherein said endless belt has at least one profiled portion which defines said at least one pusher member.

3. Apparatus according to claim 1, wherein at least two pusher members are provided, laterally spaced apart across said stacking position.

4. Apparatus according to claim 1, wherein said sheet feed means includes at least one endless belt extending through said stacking position, whereby a sheet is held on said belt by friction as said sheet is fed in said sheet accept direction.

5. Apparatus according to claim 1, wherein said sheet feed means and said at least one pusher member are driven by a common motor.

6. Apparatus according to claim 1, wherein said sheet feed means is reversible to enable sheets to be withdrawn from said stack, and said at least one pusher member being inoperative during the feeding of sheets from the stack.

7. Apparatus according to claim 6, further comprising sheet separating means positioned upstream of said stacking position in the sheet accept direction, the sheet separating means defining a gap which is variable between first and second positions and through which sheets are fed by the sheet feed means, said first position being narrower than said second position.

8. Apparatus according to claim 7, further comprising means for biasing said gap defined by the sheet separating means to said first position suitable for separating sheets fed out from the stacking position.

9. Apparatus according to claim 7, wherein said sheet separating means comprise a pair of rollers between which said gap is defined.

10. Apparatus according to claim 9, wherein one of said rollers forms part of said sheet feed means.

11. Apparatus according to claim 9, wherein one of the rollers rotates counter to the direction in which sheets are fed by said sheet feed means.

12. Sheet stacking apparatus comprising sheet feed means movable through a stacking position for feeding a sheet in a sheet accept direction to said stacking position, at least one pusher member movable in said sheet accept direction through said stacking position independently of said sheet feed means to push successive portions of a stack at the stacking position out of the path of an incoming sheet so as to permit unrestricted entry of a sheet into the stack, and said at least one pusher member defines a V-shape with the open part of the V facing an incoming sheet.

13. Sheet stacking apparatus comprising sheet feed means movable through a stacking position for feeding a sheet in a sheet accept direction to said stacking position, at least one pusher member movable in said sheet accept direction through said stacking position independently of said sheet feed means to push successive portions of a stack at the stacking position out of the path of an incoming sheet so as to permit unrestricted entry of a sheet into the stack, said sheet feed means being reversible to enable sheets to be withdrawn from said stack, and said at least one pusher member being inoperative during the feeding of sheets from the stack, and said sheet feed means and said at least one pusher member are driven by a common motor, and wherein said motor is coupled with said at least one pusher member via a one way clutch in a manner such that during the feeding of sheets from the stack, no drive is communicated to said at least one pusher member.

14. Sheet stacking apparatus comprising sheet feed means movable through a stacking position for feeding a sheet in a sheet accept direction to said stacking position;

at least one pusher member movable in said sheet accept direction through said stacking position to push successive portions of a stack at the stacking position out of the path of an incoming sheet so as to permit unrestricted entry of a sheet into the stack;

said at least one pusher member being separate from said sheet feed means;

said sheet feed means being reversible to enable sheets to be withdrawn from said stack, and said at least one pusher member being inoperative during the feeding of sheets from the stack;

said sheet feed means and said at least one pusher member are driven by a common motor, and wherein said motor is coupled with said at least one pusher member via a one way clutch in a manner such that during the feeding of sheets from the stack, no drive is communicated to said at least one pusher member.

* * * * *